US005864350A

United States Patent [19]

Shioya et al.

[11] Patent Number: 5,864,350

[45] Date of Patent: Jan. 26, 1999

[54] INK-JET PRINTING APPARATUS AND INK-JET PRINTING METHOD FOR PERFORMING PRINTING BY EJECTING INK AND PROCESSING LIQUID INSOLUBILIZING INK

[75] Inventors: Makoto Shioya, Tokyo; Ken Tsuchii, Sagamihara, both of Japan

[73] Assignee: Canon Kabushiki Kaisha, Tokyo, Japan

[21] Appl. No.: 600,129

[22] Filed: Feb. 12, 1996

[30] Foreign Application Priority Data

Feb. 13, 1995 [JP] Japan ..... 7-023587

[51] Int. Cl.[6] ..... B41J 2/145

[52] U.S. Cl. ..... 347/40

[58] Field of Search ..... 347/6, 7, 12, 14, 347/40, 41, 42, 43, 85, 102

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,538,160 | 8/1985 | Uchiyama . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,746,935 | 5/1988 | Allen . | |
| 4,967,203 | 10/1990 | Doan et al. . | |
| 5,270,738 | 12/1993 | Takahashi et al. | 347/24 |
| 5,430,469 | 7/1995 | Shioya et al. . | |
| 5,633,662 | 5/1997 | Allen et al. | 347/15 |
| 5,650,803 | 7/1997 | Tamura et al. | 347/15 |
| 5,677,716 | 10/1997 | Cleveland | 347/27 |

FOREIGN PATENT DOCUMENTS

| | | |
|---|---|---|
| 0 534 635 | 3/1993 | European Pat. Off. . |
| 0 618 076 | 10/1994 | European Pat. Off. . |
| 0 671 268 | 9/1995 | European Pat. Off. . |
| 54-056847 | 5/1979 | Japan . |
| 55-084992 | 6/1980 | Japan . |
| 56-84992 | 7/1981 | Japan . |
| 58-128862 | 8/1983 | Japan . |
| 59-123670 | 7/1984 | Japan . |
| 59-138461 | 8/1984 | Japan . |
| 60-071260 | 4/1985 | Japan . |
| 61-249755 | 11/1986 | Japan . |
| 63-299971 | 12/1988 | Japan . |
| 1-63185 | 3/1989 | Japan . |
| 64-063185 | 3/1989 | Japan . |
| 3207665 | 9/1991 | Japan . |
| 4358847 | 12/1992 | Japan . |
| 5155036 | 6/1993 | Japan . |
| WO92/18335 | 10/1992 | WIPO . |
| WO 95/03940 | 2/1995 | WIPO . |

*Primary Examiner*—Matthew Nguyen

*Attorney, Agent, or Firm*—Fitzpatrick, Cella, Harper & Scinto

[57] ABSTRACT

In an ink-jet printing apparatus in which an ink and a liquid S which insolubilizes or coagulates a dye contained in the ink are ejected to perform printing, in order to reduce consumption of the liquid in the case of employing a printing method where one pixel is formed by a plurality of scanning cycles of a head, when printing a pixel represented by red print data, a yellow ink and a magenta ink are ejected in the first to the third scanning cycles, and the liquid S is ejected only in the third scanning cycle.

21 Claims, 8 Drawing Sheets

INK-JET PRINTING APPARATUS AND INK-JET PRINTING METHOD FOR PERFORMING PRINTING BY EJECTING INK AND PROCESSING LIQUID INSOLUBILIZING INK

BACKGROUND OF THE INVENTION

1. Field of the Invention

The present invention relates to an ink-jet printing apparatus and an ink-jet printing method and, more specifically, to an ink-jet printing apparatus and an ink-jet printing method for performing printing, by insolubilizing or coagulating a color component contained in the ink, onto a printing medium.

2. Description of the Related Art

An ink-jet printing system is widely employed in printing apparatuses, copying machines, facsimile machines and so forth because its advantages in lowering noise, reducing running costs, and facilitating the miniaturization of apparatuses and the design of color printing apparatuses.

Most conventional ink-jet printing systems employ a special printing sheet provided with a waterproof ink absorbing layer to secure satisfactory water-resistance of the ink thereon and to print a color image of high coloring without bleeding of ink. Recent improvement of ink has increased the printability of an ordinary printing sheet, which is used in large quantities in printing apparatuses, copying machines and the like. However, the print quality of images printed on the ordinary printing sheets is not yet perfectly satisfactory. There have been some proposals, to improve the water-resistance property of the ordinary printing sheet and to improve printing quality.

As one method of improving the water-resistance property of the image through the improvement of ink, for example, a method of making a coloring component in the ink have the water-resistance property is known. This prior method, however, uses an ink which barely becomes soluble to water after drying. Therefore, an ejection opening of an ink-jet head using such an ink is liable to be clogged with dried ink. In addition, although it is possible to realize structure for preventing the ejection openings from being clogged, a problem that the structure requires a complex mechanism occurs.

In Japanese Patent Application Laid-open No. 84992/1981, there is disclosed a method which uses a printing medium coated with a dye fixing material. This prior method, however, needs to use a special printing medium capable of being coated with the dye fixing material, needs to use a large apparatus for coating the printing medium with the dye fixing material, and, unavoidably, increases the cost of the apparatus. Furthermore, it is comparatively difficult to coat the printing medium with a film of the dye fixing material having a predetermined thickness.

To improve printing quality, it is required that 1) characters and images must be sharply printed without occurring irregular blurring of ink on an edge of ink dots (hereinafter referred to as "feathering"), and that 2) an image is clearly printed without bleeding, i.e., without mixing of inks occurring on a boundary between adjacent regions of respective different colors. The ink must be prevented from permeating the printing medium to prevent feathering stated at article 1). In such case, however, aqueous inks, which are used by common ink-jet printing systems, are liable to cause bleeding stated at article 2). In contrast, in the case of facilitating the permeation of the ink into the printing medium, feathering is enhanced although bleeding stated at article 2) can be reduced.

In order to solve a problem set forth above, there is proposed, in Japanese Patent Application Laid-open No. 63185/1989 and Japanese Patent Application Laid-open No. 249755/1986, methods in which a clear liquid that insolubilizes the dye contained in the ink is deposited together with the ink on the printing medium by an ink-jet head.

According to methods stated above, the colored ink deposited on the printing medium is insolubilized to be fixed on the printing medium and hence a high water-resistance property of the printed product can be obtained. Both feathering and bleeding can be suppressed by applying a clear processing liquid to the printing medium under given conditions prior to ejecting ink on the printing medium.

On the other hand, there are known an ink-jet printing method of a multi-scanning system disclosed in Japanese Patent Application Laid-open Nos. 358847/1992 and 155036/1993 and an ink-jet printing method of a multi-pass system disclosed in Japanese Patent Application Laid-open No. 207665/1991 in which a plurality of scanning cycles of an ink-jet head are effected along a scanning direction to form one line of pixels. According to an above described method, one line of pixels is formed by ink droplets ejected through a plurality of different ejection openings. Therefore, variations among the ejection openings in ejection volume and an ejecting direction are averaged, so that density unevenness and misdirected landings are not liable to occur and high-quality printing can be realized.

Incidentally, the use of the aforesaid processing liquid in the foregoing multi-scanning system entails the following problems.

In this case that the processing liquid is ejected once for one ink ejecting cycle as mentioned in Japanese Patent Application Laid-open No. 63185/1989, the processing liquid is deposited in overlapping manner in the multi-scanning system, so that an excessive quantity of the processing liquid may be applied to the printing medium. As a result of this, the printing medium to which the excessive processing liquid is applied becomes cockled state which makes the surface of the printing medium rugged. And the cockled printing medium interferes with the ink-jet head and the internal components of the printing apparatus, and the cockled printing medium may possibly cause jamming and smear the printed printing medium with the ink. In some cases, the image printed on the printing medium is difficult to see and printing quality is deteriorated when the cockled printing medium dries in a cockled state.

Furthermore, since such a mode of printing consumes a large quantity of the processing liquid, a tank containing the processing liquid needs to be changed or to be replenished with the processing liquid frequently, the running cost is increased, and the load on the user increases. In case that a tank having an increased size is used to save work for changing the tank, the size of the printing apparatus needs to be increased, a cost of the printing apparatus is increased, and an operability of the printing apparatus is spoiled.

A method of reducing a deposition amount of the processing liquid is proposed in, for example, Japanese Patent Application Laid-open No. 128862/1983. In this document, when printing with a plurality of kinds of inks, data for ejecting the processing liquid is generated by carrying out logical OR between data for ejecting respective inks of colors. According to a method set forth above, when performing printing of R (red) by ejecting one Y ink (Yellow) droplet and one M ink (magenta) droplet, one processing liquid droplet for each of the Y- and the M-ink droplets is not ejected but only one processing liquid droplet is ejected. An effect of ejecting only one processing liquid droplet for two ink droplets in preventing feathering and bleeding is scarcely different from that of ejecting two processing liquid droplets for two ink droplets, the water resistance is improved effectively, and consumption of the processing liquid is reduced by ½ to ⅓ the consumption of the same by the conventional method. Even if this method is employed, however, the consumption of the processing liquid, as compared with the consumption of the ink, is considerably large.

Suppose that a full-color image is printed with, for example, Y-ink (yellow ink), an M-ink (magenta ink), a C-ink (cyan ink) and a Bk-ink (black ink) by employing the aforesaid method which carries out logical OR between the data for ejecting respective inks, the amount of the processing liquid required for printing a primary color portion, a second color portion and a third color portion is equal to, ½ and ⅓ the total amount of the inks for printing the primary color portion, the second color portion and the third color portion, respectively. In such case, suppose that an image to be printed consists of the primary color patterns of the four color inks having the same area, the second color patterns of six colors of the four color inks having the same area, or the third color patterns of the four color inks having the same area, the amount of the processing liquid necessary for printing the image is four times, two times or about 1.3 times the amount of each of the four color inks, respectively. Although one cannot make that kind of sweeping generalization because different images have different ratios in area between the primary color, the second color and the third color patterns, the amount of the processing liquid necessary for printing an image is, on an average, two to three times the amount of each color ink necessary for printing the same image.

SUMMARY OF THE INVENTION

It is an object of the present invention to provide an ink-jet printing apparatus and an ink-jet printing method in which printing is performed by ejecting an ink and a liquid which insolubilizes or coagulates the ink, and which are capable of carrying out of a multi-scanning printing method at a low consumption of the liquid.

Another object of the present invention is to provide an ink-jet printing apparatus and an ink-jet printing method which are capable of forming each of pixels by ejecting the liquid and the ink where a number of times of ejecting the liquid can be less than that of ejecting the ink.

In a first aspect of the present invention, there is provided an ink-jet printing apparatus for performing printing by ejecting an ink from an ink ejecting portion and a liquid at least containing a material which insolubilizes or coagulates a coloring material in the ink from a liquid ejecting portion, to a printing medium, the apparatus comprising:

a scanning device for moving the ink ejecting portion and the liquid ejecting portion for scanning;

an ink ejecting controller for controlling the scanning device to move the ink ejecting portion n (n is an integer not less than two) scanning cycles for one pixel and for controlling the ink ejecting portion to eject the ink to the pixel according to print data in the n scanning cycles;

a data generator for generating liquid ejecting data according to which the liquid ejecting portion ejects the liquid for pixels to be printed, on a basis of the print data for each of pixels; and a liquid ejecting controller for controlling the scanning device to move the liquid ejecting portion for scanning and for controlling the liquid ejecting portion to eject the liquid to a pixel according to the liquid ejecting data generated by the data generator in n−1 or less scanning cycles.

In a second aspect of the present invention, there is provided an ink-jet printing method for ejecting an ink and a liquid containing at least a material which insolubilizes or coagulates a coloring material in the ink, and forms one pixel by ejecting the ink in a plurality of scanning cycles, the ink-jet printing method comprising the step of:

generating a liquid ejecting signal for ejecting the liquid on a basis of an ink ejecting signal;

wherein the liquid ejecting signal is generated in different manner respectively for the plurality of scanning cycles.

In a third aspect of the present invention, there is provided an ink-jet printing method for ejecting an ink and a liquid containing at least a material which insolubilizes or coagulates a coloring material in the ink, and forms one pixel by ejecting the ink in a plurality of scanning cycles, the ink-jet printing method comprising the steps of:

generating a liquid ejecting signal for ejecting the liquid on a basis of an ink ejecting signal;

wherein a ratio S/I, where S is the number of pixels to which the liquid is ejected in one scanning cycle and I is the number of pixels to which the ink is ejected in one scanning cycle, is differentiated for each one of the plurality of scanning cycles.

In a fourth aspect of the present invention, there is provided an ink-jet printing method for ejecting an ink and a liquid containing at least a material which insolubilizes or coagulates a coloring material in the ink, and forms one pixel by ejecting the ink in a plurality of scanning cycles, the ink-jet printing method comprising the steps of:

generating a liquid ejecting signal for ejecting the liquid on a basis of an ink ejecting signal;

wherein the liquid ejecting signal is generated in different manner respectively for the plurality of scanning cycles, and a ratio S/I, where S is the number of pixels to which the liquid is ejected in one scanning cycle and I is the number of pixels to which the ink is ejected in one scanning cycle, is differentiated for each one of the plurality of scanning cycles.

In a fifth aspect of the present invention, there is provided an image forming apparatus comprising:

(a) an ink-jet printing apparatus for performing printing by ejecting an ink from an ink ejecting portion and a liquid at least containing a material which insolubilizes or coagulates a coloring material in the ink from a liquid ejecting portion, to a printing medium, the apparatus comprising:

a scanning device for moving the ink ejecting portion and the liquid ejecting portion for scanning;

an ink ejecting controller for controlling the scanning device to move the ink ejecting portion n (n is an integer not less than two) scanning cycles for one pixel and for controlling the ink ejecting portion to eject the ink to the pixel according to print data in the n scanning cycles;

a data generator for generating liquid ejecting data according to which the liquid ejecting portion ejects the liquid for pixels to be printed, on a basis of the print data for each of pixels; and a liquid ejecting controller for controlling the scanning device to move the liquid ejecting portion for scanning and for controlling the liquid ejecting portion to eject the liquid to a pixel according to the liquid ejecting data generated by the data generator in n−1 or less scanning cycles; and (b) an image reading unit for reading an original image and outputting the original image data;

wherein the ink-jet printing apparatus performs printing on a basis of print data read by the image reading unit.

In a sixth aspect of the present invention, there is provided an image forming apparatus comprising:

(a) an ink-jet printing apparatus for performing printing by ejecting an ink from an ink ejecting portion and a liquid at least containing a material which insolubilizes or coagulates a coloring material in the ink from a liquid ejecting portion, to a printing medium, the apparatus comprising:

a scanning device for moving the ink ejecting portion and the liquid ejecting portion for scanning;

an ink ejecting controller means for controlling the scanning device to move the ink ejecting portion n (n is an integer not less than two) scanning cycles for one pixel and for controlling the ink ejecting portion to eject the ink to the pixel according to print data in the n scanning cycles;

a data generator for generating liquid ejecting data according to which the liquid ejecting portion ejects the liquid for pixels to be printed, on a basis of the print data for each of pixels; and a liquid ejecting controller for controlling the scanning device to move the liquid ejecting portion for scanning and for controlling the liquid ejecting portion to eject the liquid to a pixel according to the liquid ejecting data generated by the data generator in n−1 or less scanning cycles; and (b) a print data sending and receiving unit capable of sending print data to and receiving print data from an external apparatus;

wherein the ink-jet printing apparatus performs printing on a basis of print data received by the print data sending and receiving unit.

In a seventh aspect of the present invention, there is provided an information processing apparatus comprising:

(a) an ink-jet printing apparatus for performing printing by ejecting an ink from an ink ejecting portion and a liquid at least containing a material which insolubilizes or coagulates a coloring material in the ink from a liquid ejecting portion, to a printing medium, the apparatus comprising:

a scanning device for moving the ink ejecting portion and the liquid ejecting portion for scanning;

an ink ejecting controller for controlling the scanning device to move the ink ejecting portion n (n is an integer not less than two) scanning cycles for one pixel and for controlling the ink ejecting portion to eject the ink to the pixel according to print data in the n scanning cycles;

a data generator for generating liquid ejecting data according to which the liquid ejecting portion ejects the liquid for pixels to be printed, on a basis of the print data for each of pixels; and a liquid ejecting controller for controlling the scanning means to move the liquid ejecting portion for scanning and for controlling the liquid ejecting portion to eject the liquid to a pixel according to the liquid ejecting data generated by the data generator means in n−1 or less scanning cycles; and (b) a computer;

wherein the ink-jet printing apparatus further comprises a print data receiving unit for receiving print data provided by the computer and performs printing on a basis of print data provided by the computer.

DESCRIPTION OF THE PREFERRED EMBODIMENTS

Preferred embodiments of the present invention will be described in detail with reference to the accompanying drawings.

Figure 1:
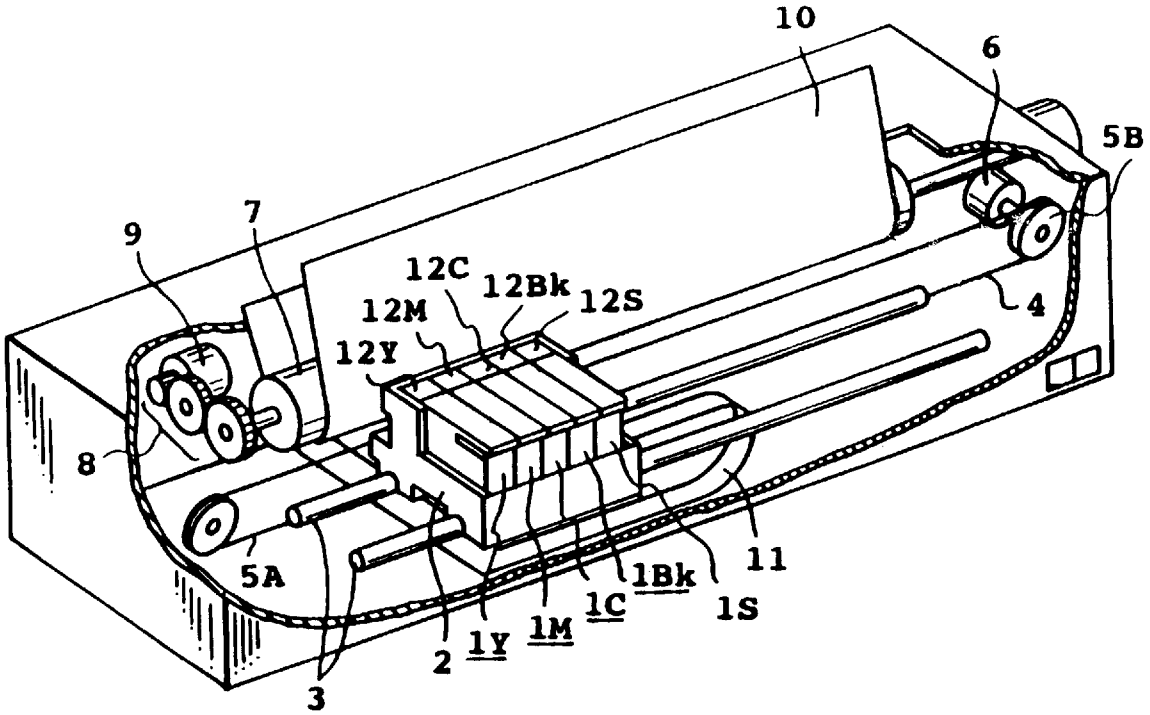
FIG. 1 is a partly cutaway schematic perspective view of an ink-jet printing apparatus in a preferred embodiment according to the present invention.

FIG. 1 is a general perspective view showing a main portion of an ink-jet apparatus.

Referring to FIG. 1, ink jet units 1Y, 1M, 1C, 1Bk and 1S are mounted on a carriage 2, and the ink jet units 1Y, 1M, 1C, 1Bk and 1S comprise heads 12Y, 12M, 12C, 12Bk and 12S respectively for ejecting a Y-ink, an M-ink, a C-ink, a Bk-ink and a liquid S (hereinafter also referred to "processing liquid"), respectively, and tanks respectively containing the Y-ink, the M-ink, the C-ink, the Bk-ink and the liquid S, respectively. Each of the ink-jet units is provided with, for example, twenty-four ejection openings arranged at intervals of 62.5 $\mu$m along the direction in which a printing sheet 10 as a printing medium is fed (hereinafter also referred to as "auxiliary direction"). Heaters to generate thermal energy utilized for ejecting an ink are provided on ink passages connected to the ejection openings, respectively. The respective heaters generate thermal energy in response to application of the electric pulses in accordance with driving data to cause film boiling in the ink or the liquid S, and to produce a bubble so that a droplet of the ink or the liquid S is ejected through the corresponding ejection opening.

The carriage 2 detachably mounts the heads 12Y, 12M, 12C, 12Bk and 12S and the tanks, and is slidably engaged on and travels along two parallel guide shafts 3. The carriage 2 is driven for travel along the guide shafts 3 through a belt 4 fastened to part of the carriage 2 and extended between pulleys 5A and 5B by a carriage motor 6. A flexible cable 11 is connected to the heads 12Y, 12M, 12C, 12Bk and 12S, respectively, so that ink ejecting signals and control signals based on a print data are transformed from a host system or a control portion included in the ink-jet printing apparatus to respective head driver circuits (head drivers) included in the respective heads.

A platen roller 7 is extended with its axis in parallel to axes of the guide shafts 3 and is driven for rotation by a feeding motor 9 to feed the printing sheet 10. The platen roller 7 sets a printing surface of the printing sheet 10 in plane state. In a construction set forth above, the heads 12Y, 12M, 12C, 12Bk and 12S of the ink jet units 1Y, 1M, 1C, 1Bk and 1S eject the inks onto a printing region of the printing sheet 10 positioned opposite to the ejection openings of the head as the carriage 2 travels for printing.

Figure 2:
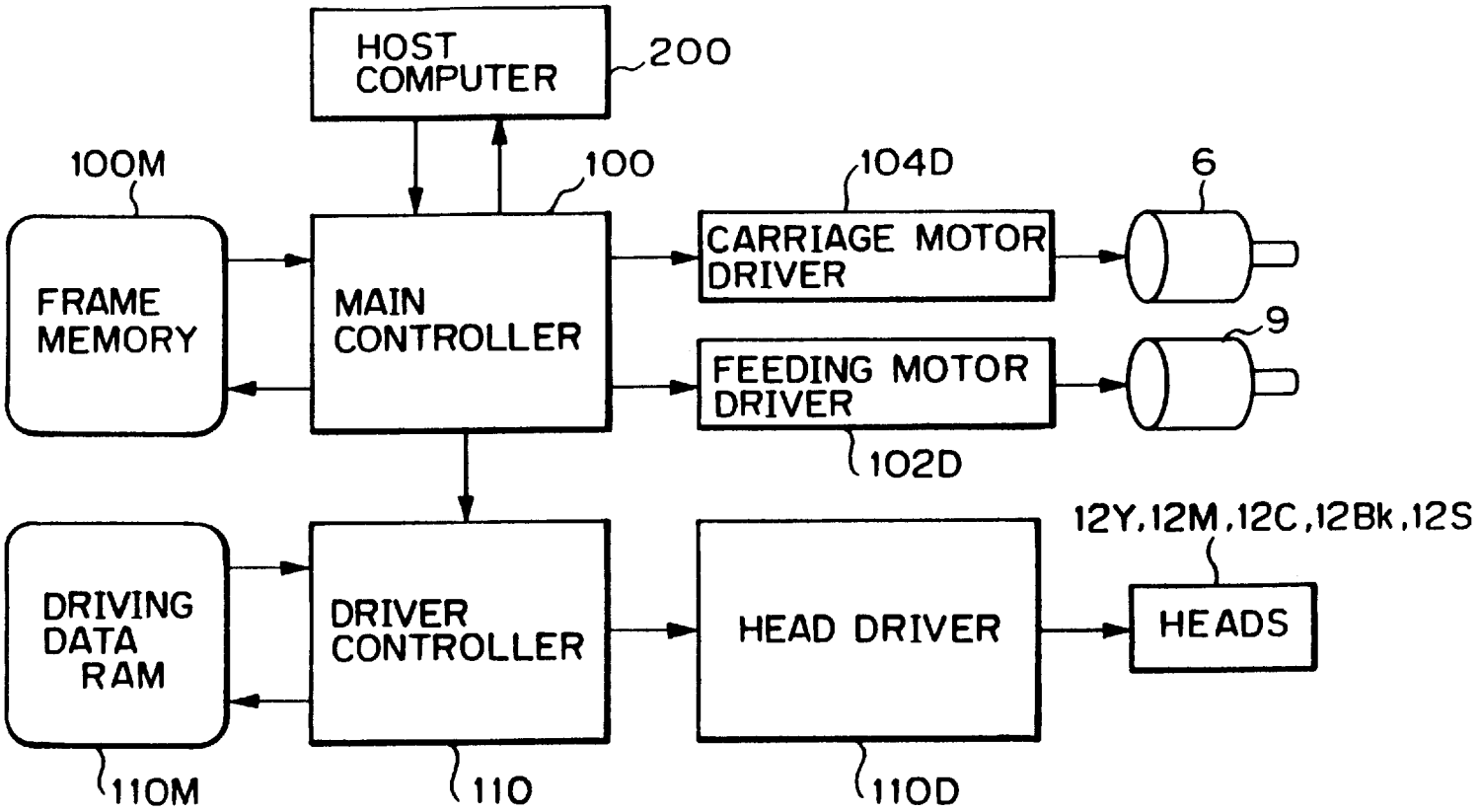
FIG. 2 is a block diagram showing control structure included in the ink-jet printing apparatus of FIG. 1.

FIG. 2 is a block diagram showing control structure included in the ink-jet printing apparatus of FIG. 1. A main controller 100 comprises a CPU or the like, converts image data given thereto from a host computer 200 into pixel data combined with tone data and stores the pixel data in a frame memory 100M. The main controller 100 gives the tone data of the pixels stored in the frame memory 100M to a driver controller 110 at predetermined timing. The driver controller 110 converts the tone data into ejecting control data representing on/off of the respective heaters which are made corresponding to ejection opening numbers (which indicate an order in one ejection opening array) and to scanning numbers (which indicate a number of scanning cycles). The driver controller 110 reads the driving data corresponding to the ejection opening numbers and the scanning numbers from the driving data RAM 110 according to control signals given from the main controller 100, gives the driving data to a head driver 110D, and controls timing of driving of the head driver 110D.

The main controller 100 controls the ejecting operations of the heads 12Y, 12M, 12C, 12Bk and 12S, the driving operations of the carriage motor 6 and the feeding motor 9 through a carriage motor driver 104D and a feeding motor driver 102D, respectively. Whereby characters or images according to image data are printed on the printing sheet 10.

It should be noted that the main controller 100 may be used instead of the driver controller 110 for converting the tone data into the ejecting data. This structure enables the storage of the ejecting data in the frame memory 100M and the omission of the RAM 110M.

Embodiments of ink-jet printing methods in accordance with the present invention, which methods can be applied to the foregoing ink-jet printing apparatus will be described hereinafter.

Figure 3:
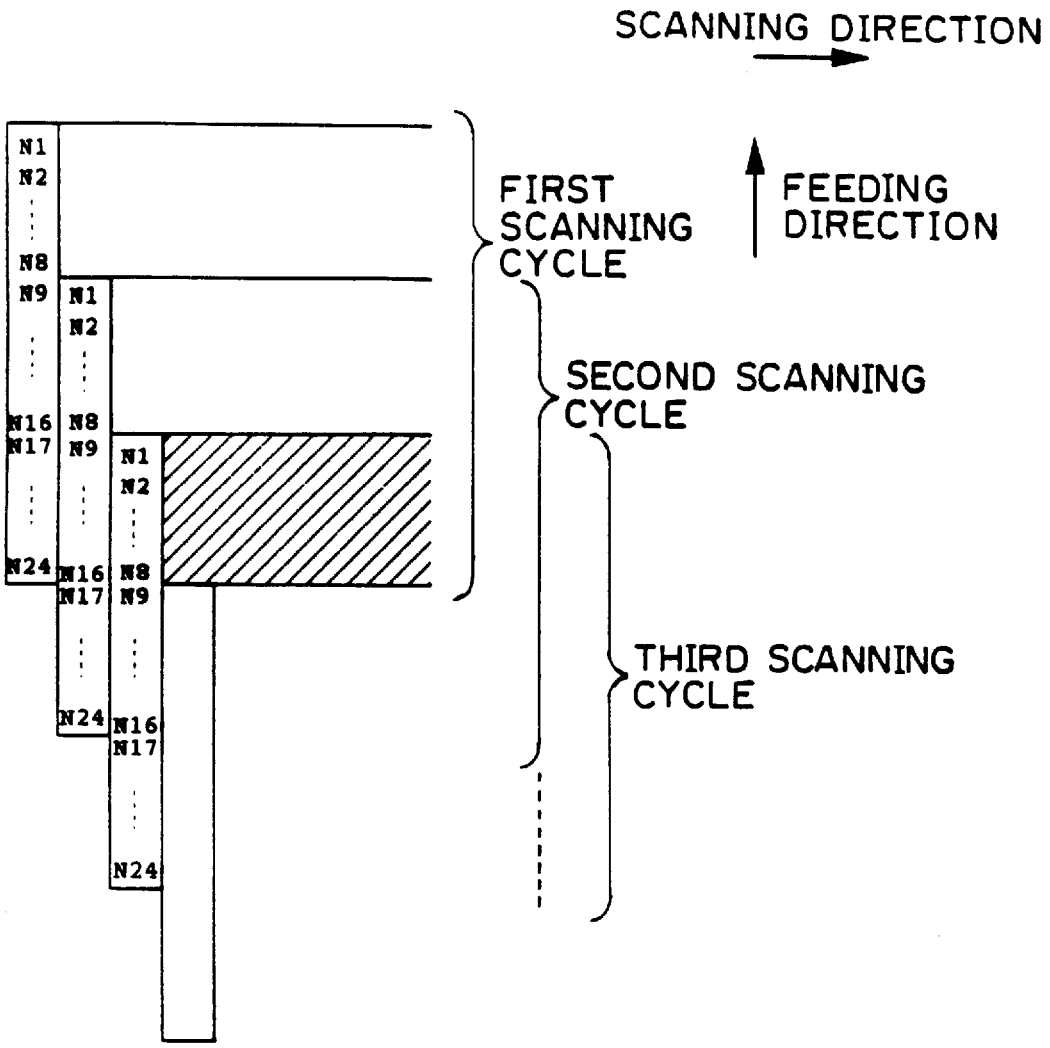
FIG. 3 is a diagrammatic view for explaining operation of the embodiment.

FIG. 3 is a conceptual diagram for explaining a printing method in an embodiment according to the present invention.

In the following description, the operations of one of the five heads will be explained as an example.

Referring to FIG. 3, when performing printing on the printing sheet, the ink is ejected onto a blank region of the printing sheet to which the ink is not yet ejected through the ejection openings N17 to N24 as the carriage scans. In a first dot forming, only one of three ink dots which is a maximum number of dots capable of forming each of the pixels is formed.

Then, as shown in FIG. 3, the printing sheet is fed (in FIG. 3, the head is shifted down relative to the printing sheet for convenience' sake) by a distance corresponding to the eight ejection openings and the ejection openings N9 to N24 are used for printing. Further, the printing sheet is fed again by a distance corresponding to the eight ejection openings and the ejection openings N1 to N24 are used for printing. Thus, a shaped region shown in FIG. 3 is formed by ink droplets ejected in the first, the second and the third scanning cycle.

Next, the printing sheet is further fed by a distance corresponding to the eight ejection openings, and the ejection openings N1 to N24 are used for printing. This printing operation is repeated to perform printing on an entire surface of the printing sheet.

Before discussion of the methods, the processing liquid (a liquid at least containing a material which insolubilizes or coagulates a coloring material in the ink) and the ink employed in embodiments will be discussed below.

| Composition of processing liquid | |
|---|---|
| PAA-HC1-3L (Nittoboh, Inc.) | 5.0 wt. % |
| Cation G50 (Sanyo Kasei, Inc.) | 0.3 wt. % |
| Diethylene Glycol | 10.0 wt. % |
| Lithiumacetate | 0.5 wt. % |
| Water | 84.2 wt. % |
| Composition of inks | |
| Glycerine | 7.5 wt. % |
| Thiodiglycol | 7.5 wt. % |
| Urea | 7.5 wt. % |
| Dyestuff | 3.5 wt. % |
| Y C.I. Direct Yellow 142 | |
| M C.I. Acid Red 289 | |
| C C.I. Direct Blue 199 | |
| Bk C.I. Food Black 2 | |
| Acetylenol EH (Kawa-Ken Chemical, Inc.) | 1.0 wt. % |
| Water | 73.0 wt. % |

In mixing of the processing liquid and the ink as set forth above, in the present invention, as a result of mixing of the processing liquid and the ink on the printing medium or at a position penetrating the printing medium in a certain magnitude, as the first stage of reaction, low molecule component or cation type oligomer in the cation type substance contained in the processing liquid, and the water soluble dye having anion type group cause association by ionic interaction to separate from solution phase at a moment.

Next, as the second stage of reaction, an association body of the above-mentioned dye and low molecule cation type substance or cation type oligomer is absorbed by high molecule components included in the processing liquid. Therefore, the coagulated body of the dye becomes further greater in size to become difficult to penetrate into the gap between the fiber of the printing medium. As a result, only the liquid portion resulting from solid/liquid separation penetrates into the printing paper, and both of printing quality and sensibility can be achieved. At the same time, viscosity of the coagulated body formed of the low molecule component of the cation substance or cation type oligomer, anion type dye and cation type substance, is increased to so as not to move according to movement of the liquid medium. Therefore, even when the adjacent ink dots are formed with different colors as in formation of a full color image, the colors may not be mixed with each other. Therefore, bleeding is not caused. Also, since the coagulated body is essentially water insoluble, the moisture resistance of the formed image becomes complete. Also, color fastness to light of the formed image can be improved by the shielding effect of the polymer.

It should be noted that the kind of the printing medium is not specified in implementation of the present invention, and conventionally used plain paper, such as copy paper, bond paper and so forth can be suitably used. Of course, a coated paper specially prepared for ink-jet printing, transparent film for OHP and so forth may also be used suitably. Also, general wood free paper, glossy paper and so forth may also used suitably.

(First Embodiment)

Figures 4A, 4B:
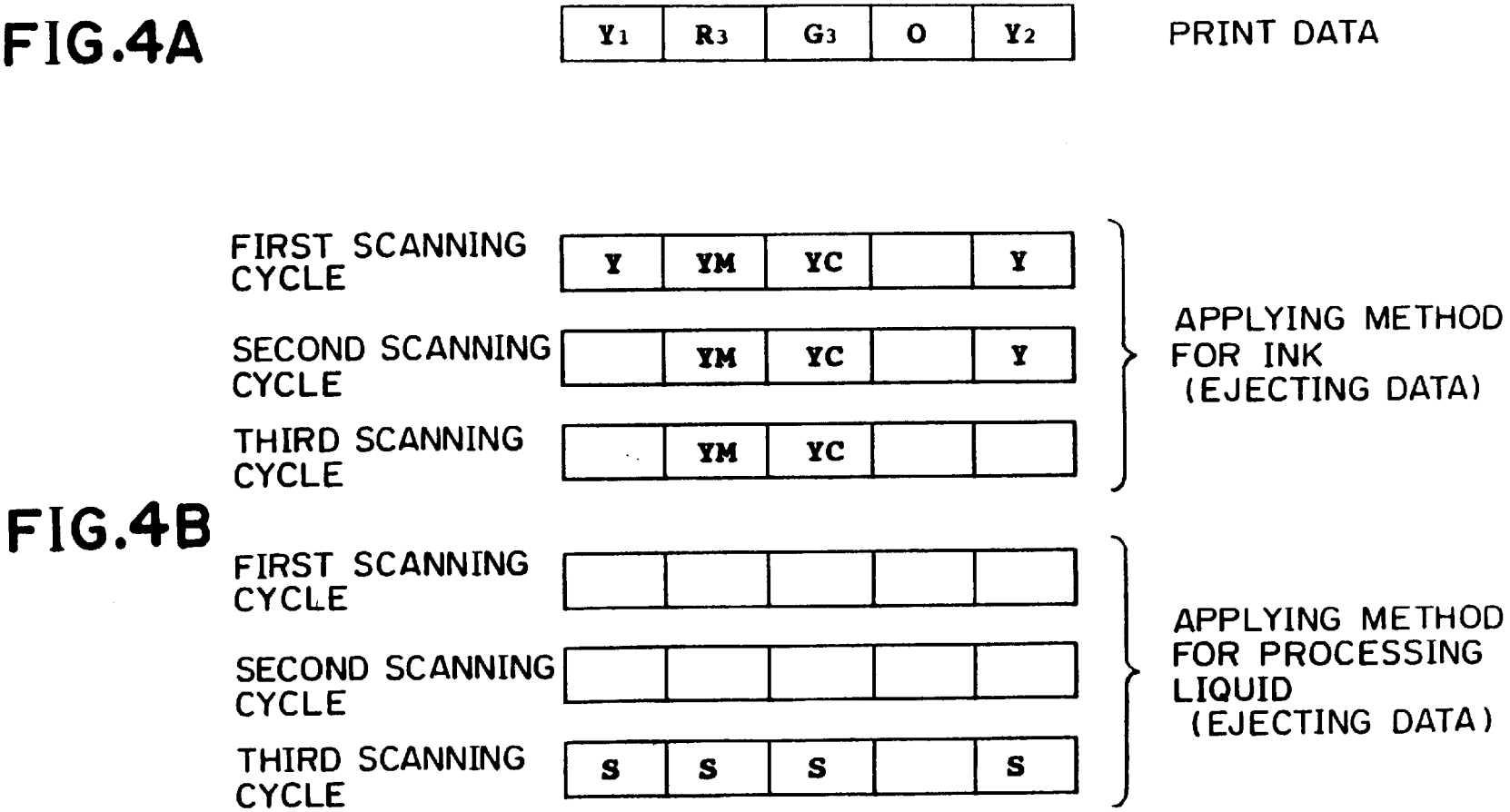
FIGS. 4A and 4B are diagrams for explaining a printing method in a first embodiment according to the present invention.

FIGS. 4A and 4B are diagrams for explaining a printing method of a first embodiment according to the present invention. In the printing method, the liquid is ejected in a later scanning cycle.

When printing an image represented by print data shown in FIG. 4A, the inks and the liquids are ejected according to ejecting data shown in FIG. 4B.

In FIG. 4A, $Y_1$ signifies forming one Y-dot (yellow dot) for a pixel, $R_3$ signifies forming three R-dots (red dots), $G_3$ signifies forming three G-dots (green dots), $Y_2$ signifies forming two Y-dots, and 0 signifies not forming any dot.

FIG. 4B shows ejecting data of the ink and the liquid for ejecting the inks and the liquids, respectively, in the first to the third scanning cycles with respect to the print data shown in FIG. 4A. For example, the Y-ink and the M-ink are ejected in each of the first to the third scanning cycles to form a pixel represented by the print data $R_3$.

On the other hand, the liquid (S) is ejected only in the third scanning cycle only for pixels corresponding to the ejecting data of ink for any of the first to the third scanning cycle.

The ejecting data of ink may be assigned to the scanning cycles by, for example, a method disclosed in Japanese Patent Application Laid-Open No. 5-155036, and hence the description thereof will be omitted.

As set forth above, the liquid is ejected only in the last scanning cycle, the ink-jet printing apparatus is able to operate at a reduced liquid consumption. Although, in this printing method, a comparatively small quantity of the liquid is applied to the printing medium, the following problems may possibly arise.

1) Feathering is liable to occur in earlier scanning cycles, i.e., the first and the second scanning cycle.

2) Similarly, bleeding is liable to occur in the earlier scanning cycles.

3) The use of the comparatively small quantity of the liquid reduces the water-resistance property of a printed product.

Although it is possible that feathering occurs in the earlier scanning cycles as stated in article 1), an amount of the ink forming one pixel becomes comparatively small in the case that the ink necessary for forming one pixel is divided to be ejected in a plurality of scanning cycles, therefore, feathering, if any, is not very significant.

Regarding bleeding stated in article 2), since bleeding is greatly dependent on the total amount of the ink applied to the printing sheet, bleeding rarely occurs when the amount of the ink is applied to the printing sheet in the earlier scanning cycles. Therefore, bleeding is not so serious problem.

The problem in the water-resistance property stated in article 3) will not arise when the liquid having a dye insolubilizing liquid concentration high enough to insolubilize or coagulate the dye with a small quantity of the liquid is used.

It should be noted that a small amount of the liquid may be independently ejected in earlier scanning cycle to suppress feathering stated in the article 1). In addition, it is preferable to use part of the liquid to be used in a later scanning cycle in an earlier scanning cycle.

(Second Embodiment)

In a printing method in a second embodiment according to the present invention, the liquid is ejected only in earlier scanning cycle and is not ejected in later scanning cycles. The printing method will be described with reference to FIGS. 5A and 5B.

Figures 5A, 5B:
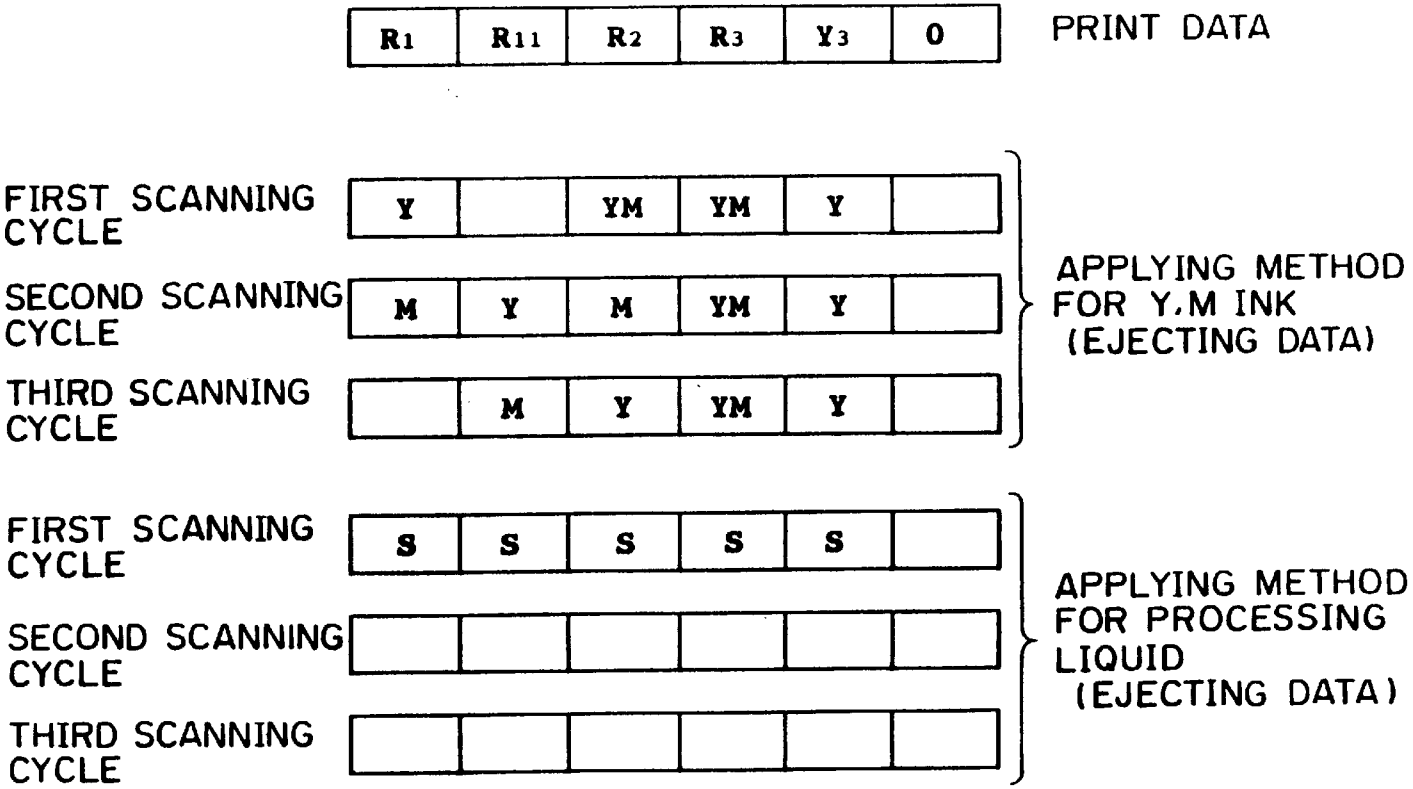
FIGS. 5A and 5B are diagrams for explaining a printing method in a second embodiment according to the present invention.

An image represented by print data shown in FIG. 5A is printed by performing printing on a basis of ejecting data shown in FIG. 5B. The print data shown in FIG. 5A is similar to that shown in FIG. 4A, and the ejecting data shown in FIG. 5B is similar to that shown in FIG. 4B. However, in FIG. 5A, $R_{11}$, similarly to $R_1$, specifies forming one R-dot (red dot), but the print data represented by $R_{11}$ signifies ejecting the Y-ink and the M-ink for realizing the color in the second and the third scanning cycle, respectively. The liquid S is ejected in the first scanning cycle as a preceding scanning cycle, which is different from the liquid ejecting operation shown in FIG. 4B.

This printing method, similarly to the printing method in the first embodiment, reduces the consumption of the liquid. The reduction of the amount of the liquid may possibly entail feathering, bleeding and the deterioration of water-resistance property. However, although admittedly, print quality is deteriorated little in respect of bleeding, significant bleeding hardly occurs because all the ink droplets are ejected onto places to which the liquid droplets have previously been ejected and the ink droplets ejected on the printing sheet are affected by the liquid to a certain degree. The effect regarding water-resistance property is satisfactorily obtained when the liquid has a dye insolubilizing component concentration high enough to insolubilize the dye contained in the ink.

In the case that the ink droplets are ejected in a scanning cycle following a scanning cycle in which the liquid is ejected, light feathering occurs in, for example, pixels represented by print data $R_1$ and $R_{11}$ shown in FIG. 5A. Particularly, relatively significant feathering occurs in a pixel represented by print data $R_3$ in scanning cycles in which the liquid is not ejected and a comparatively large amount of the inks is ejected. However, since the liquid droplets are ejected onto the printing sheet in an earlier scanning cycle, the degree of feathering is lower than that when the liquid is not ejected at all. In addition, since in the shown embodiment the total amount of the inks necessary for forming one pixel is distributed to be ejected in a plurality of scanning cycles, the amount of the inks ejected in one scanning cycle is comparatively small and hence significant feathering does not occur.

Since the multi-scanning method distributes the total amount of the inks necessary for printing to a plurality of scanning cycles, the amount of the inks applied to the printing sheet in a unit time is comparatively small, and hence cockling rarely occurs. However, when the liquid is applied to the printing sheet in an earlier scanning cycle as is done by the shown embodiment, such an advantage disappears and cockling is liable to occur. In case that cockling is caused in an earlier scanning cycle of a multi-scanning printing method, ink droplets ejected in a later scanning cycle impinge on the printing sheet at positions deviating from correct positions even if cockling is on a level that may not affect the travel of the printing sheet and, consequently, a blurred image is printed. Although such problems reside in the printing method in the shown embodiment, the printing method of the shown embodiment, as mentioned above, has advantages of suppressing bleeding, securing satisfactory water-resistance property and reducing liquid consumption and, therefore, the printing method is capable of printing an image having a satisfactory water-resistance property and less subject to feathering, using a comparatively small amount of the liquid.

It should be noted that, to prevent cockling, the amount of the ink to be ejected in a later scanning cycle may be reduced according to the amount of the liquid ejected in an earlier scanning cycle.

(Third Embodiment)

In a printing method of a third embodiment according to the present invention, three scanning cycles are used for printing pixels. The liquid is ejected in the first and the third scanning cycle and is not ejected at all in the second scanning cycle.

Although the amount of the liquid necessary for carrying out the printing method is greater than that of the liquid necessary for carrying out the printing methods in the first and the second embodiments, the printing method in the third embodiment is capable of effectively preventing feathering and bleeding.

It should be noted that it is preferable to thin the data for ejecting the liquid to be used in the first and the third scanning cycles properly to reduce the amount of the liquid. The reduced amount of the liquid to be used in the first and the third scanning cycle is determined taking into consideration balance between the advantageous effect of the reduction of the necessary amount of the liquid and problems attributable to feathering and bleeding.

(Fourth Embodiment)

In a printing method in a fourth embodiment according to the present invention, the liquid for alternate pixels on each pixel line is ejected in the first and the third scanning cycles. By this, the amount of the liquid needed for printing is substantially equal to that of the first and the second embodiments, and this method is capable of satisfactorily suppressing feathering and bleeding.

(Fifth Embodiment)

In a printing method in a fifth embodiment according to the present invention, different liquid ejecting methods are used for different types of images. Generally, it is desirable to print characters so that the printed characters have sharp edges and hence feathering that spoils the sharpness of the edges of the characters must be suppressed to the least possible extent. Accordingly, the liquid is ejected in an earlier scanning cycle when printing characters.

On the other hand, feathering is scarcely conspicuous in a pictorial image, and cockling often causes color shift. Accordingly, when printing the pictorial image, the liquid is ejected in a later scanning cycle.

Thus, the printing method may be carried out in different printing modes for different types of images to be printed.

Even in the pictorial image, feathering is conspicuous in edge portions, particularly, edge portions where density difference is large, and in line drawings. Therefore, it is preferable to eject the liquid in an earlier scanning cycle when printing the pictorial image having such portions.

A liquid ejecting mode appropriate to the type of an image to be printed may be specified by a user, by a host computer on a basis of image signals or by an internal means of the printing apparatus.

Ink usable for carrying out the present invention should not be limited only to dyestuff ink, and pigment ink having pigment dispersed therein can also be used. Any type of treatment liquid can be used, provided that pigment is aggregated with it. The following pigment ink can be noted as an example of pigment ink adapted to cause aggregation by mixing with the treatment liquid A1 previously discussed. As mentioned below, yellow ink Y2, magenta ink M2, cyan ink C2 and black ink K2 each containing pigment and anionic compound can be obtained.

[Black ink K2]

The following materials are poured in a batch type vertical sand mill (manufactured by Aimex Co.), glass beads each having a diameter of 1 mm are filled as media using anion based high molecular weight material P-1 (aqueous solution containing a solid ingredient of styrene methacrylic acid ethylacrylate of 20% having an acid value of 400 and average molecular weight of 6000, neutralizing agent:potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

| (Composition of carbon black dispersing element) | |
|---|---|
| P-1 aqueous solution (solid ingredient of 20%) | 40 parts |
| carbon black Mogul L (manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow ink Y2]

Anionic high molecular P-2 (aqueous solution containing a solid ingredient of 20% of stylen-acrlylic acid methyl methaacrylate having an acid value of 280 and an average molecular weight of 11,000, neutralizing agent:diethanolamine) is used as a dispersing agent and dispersive treatment is conducted in the same manner as production of the black ink K2 whereby yellow color dispersing element having a weight-average grain size of 103 nm is produced.

| (composition of yellow dispersing element) | |
|---|---|
| P-2 aqueous solution (having a solid ingredient of 20%) | 35 parts |
| C. I. pigment yellow 180 (tradename: Nobapalm yellow PH-G, manufactured by Hext Co.) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan ink C2]

Cyan colored-dispersant element having a weight-average grain size of 120 nm is produced using anionic high molecular P-1 as dispersing agent, and moreover, using the following materials by conducting dispersing treatment in the same manner as the carbon black dispersing element.

| (composition of cyan colored-dispersing element) | |
|---|---|
| P-1 aqueous solution (having solid ingredient of 20%) | 30 parts |
| C. I. pigment blue 153 (trade name: Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

| (composition of the magenta colored dispersing element) | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 6:
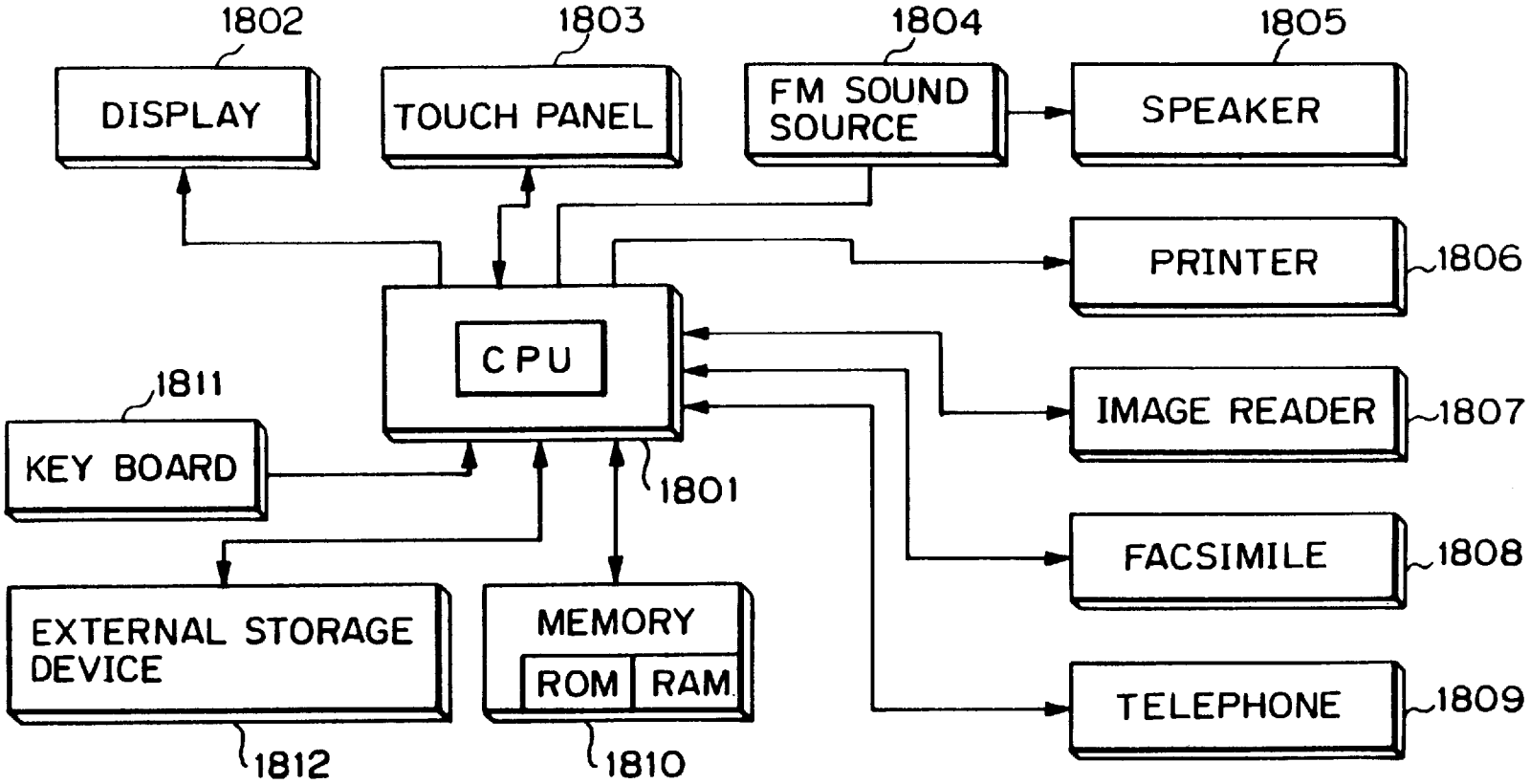
FIG. 6 is a block diagram of an information processing system, by way of example, employing the ink-jet printing apparatus embodying the present invention.

FIG. 6 is a block diagram showing general construction of an information processing apparatus having a function of wordprocessor, personal computer, facsimile machine, a copy machine and so forth, to which the printing apparatus according to the present invention is applied.

In the drawings, a reference numeral 1801 denotes a control portion performing control of the overall apparatus, which includes CPU, such as microprocessor and so forth, and various I/O port, to perform control for outputting control signal or data signal and so forth to respective portions and inputting control signal or data signal from the respective portions. A reference numeral 1802 denotes a display portion having a display screen, on which various menu, document information and image or so forth read by an image reader 1807 are displayed. A reference numeral 1803 denotes a transparent pressure sensitive touch panel provided on the display portion 1802 for performing item entry or coordinate portion entry on the display portion 1802 by depressing the surface thereof by a finger or so forth.

A reference numeral 1804 denotes a FM (frequency modulation) sound source portion which stores music information produced by a music editor and so forth in a memory portion 1810 or an external memory 1812 and performs FM modulation by reading out the stored music information from the memory portion or so forth. An electric signal from the FM sound source portion 1804 is transformed into an audible sound by a speaker portion 1805. A printer portion 1806 is employed as an output terminal of the wordprocessor, the personal computer, the facsimile machine, the copy machine and so forth, in which the printing apparatus according to the present invention is applied.

A reference numeral 1807 denotes an image reader portion for optoelectrically reading out original data for inputting, which is located at the intermediate position in an original feeding path and performs reading out various original documents, such as original document for facsimile machine or copy machine. A reference numeral 1808 denotes a facsimile (FAX) transmission and reception portion for transmitting original data read by the image reader portion or for receiving transmitted facsimile signal, which facsimile transmission and reception portion has an external interface function. A reference numeral 1809 denotes a telephone machine portion having a normal telephone function and various associated functions, such as a recording telephone and so forth.

A reference numeral 1810 denotes a memory portion including a ROM storing a system program, a manager program, other application programs and so forth, as well as character fonts, dictionary and so forth, a RAM for storing application programs loaded from an external storage device 1812, document information, video information and so forth.

A reference numeral 1811 denotes a keyboard portion inputting document information or various commands. A reference numeral 1812 denotes the external storage device employing a floppy or hard drive as storage medium. In the external storage device 1812, document information, music or speech information, application program of the user and so forth are stored.

Figure 7:
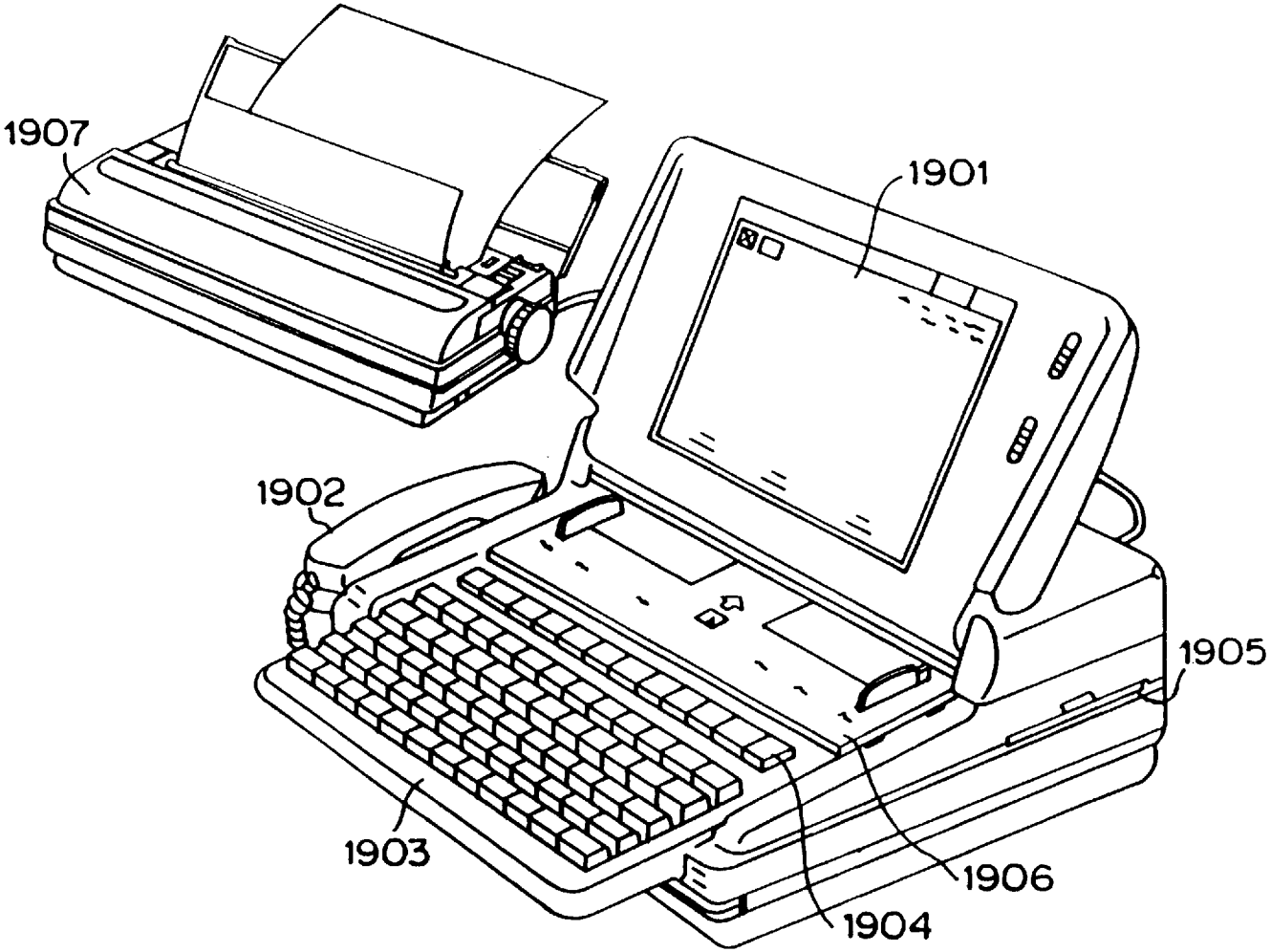
FIG. 7 is a perspective view of the information processing system of FIG. 6.

FIG. 7 is a diagrammatic external view of the information processing system shown in FIG. 6.

In FIG. 7, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink-jet printer 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth above is operated as the personal computer or the wordprocessor, various information input through the keyboard portion 1811 is processed according to a predetermined program by the control portion 1801 and output as printed image by the printer portion 1806.

When the information processing apparatus is operated as a receiver of the facsimile machine, facsimile information input from the FAX transmission and reception portion 1808 via a communication network is subject to a reception process according to the predetermined program and output as received image by the printer portion 1808.

In addition, when the information processing apparatus is operated as a copy machine, the original is read by the image reader portion 1807 and the read original data is output to the printer portion as copy image via the control portion 1801. It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

Figure 8:
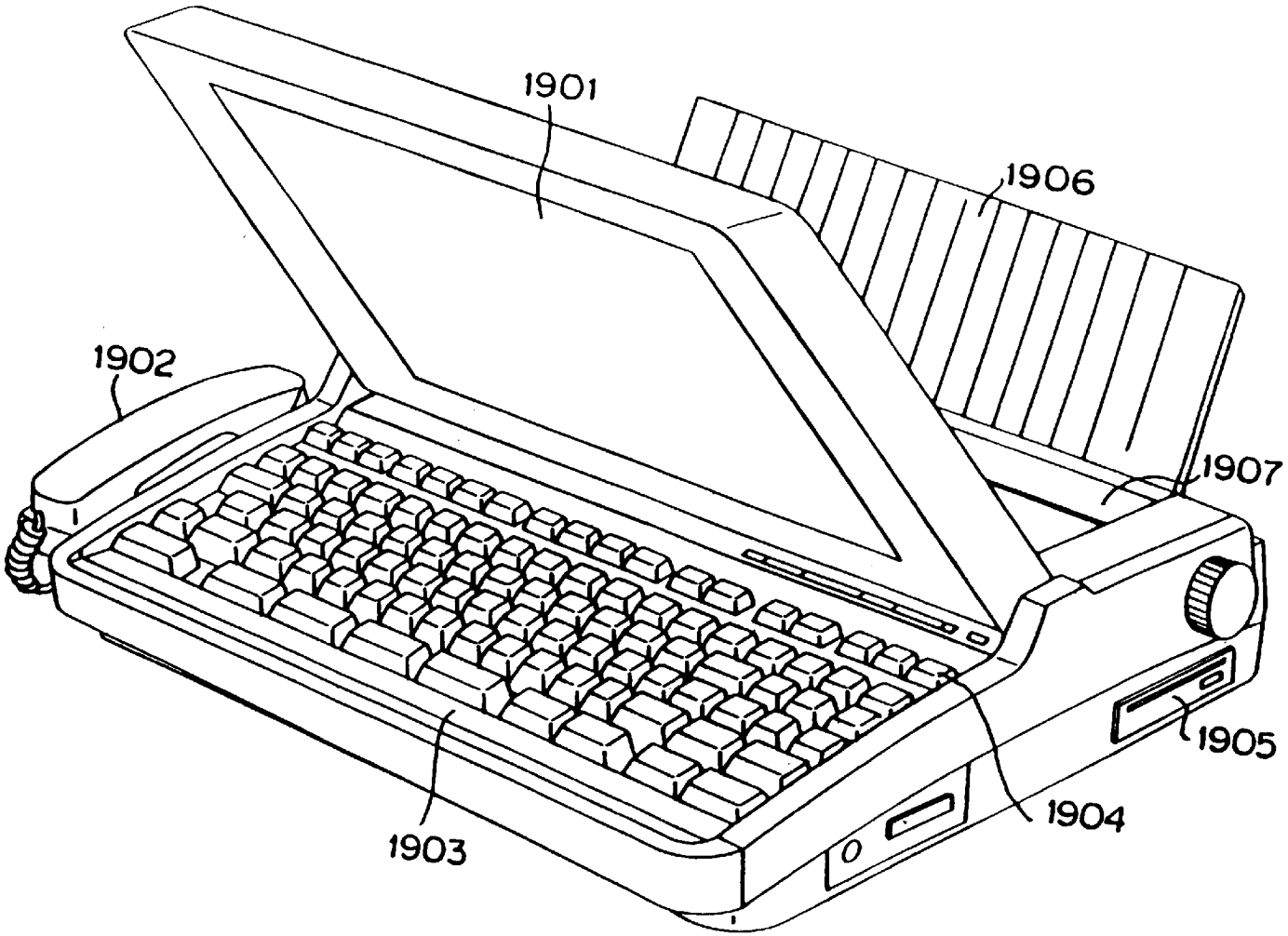
FIG. 8 is a perspective view of another information processing system employing the ink-jet printing apparatus embodying the present invention.

It should be noted that the information processing apparatus may be an integrated type incorporating the ink-jet printer within a main body as illustrated in FIG. 8. In this case, portability can be further improved. In FIG. 8, the portions having the same function in FIG. 7 are shown with the corresponding reference numerals.

As is obvious from the foregoing description, the number of liquid ejecting cycles can be reduced below the number of ink ejecting cycles when printing pixels. Accordingly, any multi-scanning printing method can be carried out at a reduced liquid consumption, and images having a satisfactory water-resistance property can be printed in a satisfactory print quality.

What is claimed is:

1. An ink-jet printing apparatus for performing printing by ejecting an ink from an ink ejecting portion and a liquid at least containing a material which insolubilizes or coagulates a coloring material in the ink from a liquid ejecting portion, to a printing medium, said apparatus comprising:

a scanning device for moving the ink ejecting portion and the liquid ejecting portion for scanning;

an ink ejecting controller for controlling said scanning device to move said ink ejecting portion n (n is an integer not less than two) scanning cycles for one pixel and for controlling the ink ejecting portion to eject the ink to the pixel according to print data in said n scanning cycles;

a data generator for generating liquid ejecting data according to which said liquid ejecting portion ejects the liquid for pixels to be printed, on a basis of the print data for each of pixels; and a liquid ejecting controller for controlling said scanning device to move said liquid ejecting portion for scanning and for controlling said liquid ejecting portion to eject the liquid to a pixel according to the liquid ejecting data generated by said data generator in n−1 or less scanning cycles.

2. An ink-jet printing apparatus as claimed in claim 1, wherein the number of times indicated by said n−1 or less of scanning cycles is one, and the one scanning cycle corresponds to a last one scanning cycle of the n scanning cycles of said ink ejecting portion.

3. An ink-jet printing apparatus as claimed in claim 1, wherein the number of times indicated by said n−1 or less of scanning cycles is one, and the one scanning cycle corresponds to a first one scanning cycle of the n scanning cycles of said ink ejecting portion.

4. An ink-jet printing apparatus as claimed in claim 1, wherein the number of times indicated by said n−1 or less of scanning cycles is one, and the one scanning cycle corresponds to a last one or a first one scanning cycle of the n scanning cycles of said ink ejecting portion.

5. An ink-jet printing apparatus as claimed in claim 1, wherein the number of times indicated by said n−1 or less of scanning cycles is two, and the one scanning cycle corresponds to a last one and a first one scanning cycles of the n scanning cycles of said ink ejecting portion.

6. An ink-jet printing apparatus as claimed in claim 5, wherein the liquid contains a low-molecular cationic material and a high-molecular cationic material, and the ink contains an anionic dye.

7. An ink-jet printing apparatus as claimed in claim 5, wherein the liquid contains a low-molecular cationic material and a high-molecular cationic material, and the ink contains an anionic compound and a pigment.

8. An ink-jet printing apparatus as claimed in claim 5, wherein the ink ejecting portion and the liquid ejecting portion produce a bubble in the ink and the liquid, respectively, by using thermal energy to eject the ink and the liquid, respectively, by the agency of the bubble.

9. An ink-jet printing method for ejecting an ink and a liquid containing at least a material which insolubilizes or coagulates a coloring material in the ink, and forms one pixel by ejecting the ink in a plurality of scanning cycles, said ink-jet printing method comprising the step of:

generating a liquid ejecting signal for ejecting the liquid on a basis of an ink ejecting signal;

wherein the liquid ejecting signal is generated in a different manner respectively for the plurality of scanning cycles.

10. An ink-jet printing method for ejecting an ink and a liquid containing at least a material which insolubilizes or coagulates a coloring material in the ink, and forms one pixel by ejecting the ink in a plurality of scanning cycles, said ink-jet printing method comprising the step of:

generating a liquid ejecting signal for ejecting the liquid on a basis of an ink ejecting signal;

wherein a ratio S/I, where S is the number of pixels to which the liquid is ejected in one scanning cycle and I is the number of pixels to which the ink is ejected in one scanning cycle, is differentiated for each one of the plurality of scanning cycles.

11. An ink-jet printing method for ejecting an ink and a liquid containing at least a material which insolubilizes or coagulates a coloring material in the ink, and forms one pixel by ejecting the ink in a plurality of scanning cycles, said ink-jet printing method comprising the step of:

generating a liquid ejecting signal for ejecting the liquid on a basis of an ink ejecting signal;

wherein the liquid ejecting signal is generated a different manner respectively for the plurality of scanning cycles, and a ratio S/I, where S is the number of pixels to which the liquid is ejected in one scanning cycle and I is the number of pixels to which the ink is ejected in one scanning cycle, is differentiated for each one of the plurality of scanning cycles.

12. An ink-jet printing method as claimed in claim 11, wherein the ratio S/I for a later scanning cycle is greater than that for an earlier scanning cycle.

13. An ink-jet printing method as claimed in claim 11, wherein the ratio S/I for the an earlier scanning cycle is greater than that for a later scanning cycle.

14. An ink-jet printing method as claimed in claim 11, wherein the ratio S/I=0 for an earlier scanning cycle.

15. An ink-jet printing method as claimed in claim 11, wherein the ratio S/I=0 for a later scanning cycle.

16. An ink-jet printing method as claimed in claim 11, wherein the number of the scanning cycles is three or more, and the ratio S/I for an intermediate scanning cycle is smaller than that for the preceding scanning cycle and that for the succeeding scanning cycle.

17. An ink-jet printing method as claimed in claim 16, wherein the ratio S/I=0 for the intermediate scanning cycle.

18. An image forming apparatus comprising:

(a) an ink-jet printing apparatus for performing printing by ejecting an ink from an ink ejecting portion and a liquid at least containing a material which insolubilizes or coagulates a coloring material in the ink from a liquid ejecting portion, to a printing medium, said ink-jet apparatus comprising:

a scanning device for moving the ink ejecting portion and the liquid ejecting portion for scanning;

an ink ejecting controller for controlling said scanning device to move said ink ejecting portion n (n is an integer not less than two) scanning cycles for one pixel and for controlling the ink ejecting portion to eject the ink to the pixel according to print data in said n scanning cycles;

a data generator for generating liquid ejecting data according to which said liquid ejecting portion ejects the liquid for pixels to be printed, on a basis of the print data for each of pixels; and a liquid ejecting controller for controlling said scanning device to move said liquid ejecting portion for scanning and for controlling said liquid ejecting portion to eject the liquid to a pixel according to the liquid ejecting data generated by said data generator in n−1 or less scanning cycles; and (b) an image reading unit for reading an original image and outputting the original image data;

wherein said ink-jet printing apparatus performs printing on a basis of print data read by said image reading unit.

19. An image forming apparatus comprising:

(a) an ink-jet printing apparatus for performing printing by ejecting an ink from an ink ejecting portion and a liquid at least containing a material which insolubilizes or coagulates a coloring material in the ink from a liquid ejecting portion, to a printing medium, said ink-jet apparatus comprising:

a scanning device for moving the ink ejecting portion and the liquid ejecting portion for scanning;

an ink ejecting controller means for controlling said scanning device to move said ink ejecting portion n (n is an integer not less than two) scanning cycles for one pixel and for controlling the ink ejecting portion to eject the ink to the pixel according to print data in said n scanning cycles;

a data generator for generating liquid ejecting data according to which said liquid ejecting portion ejects the liquid for pixels to be printed, on a basis of the print data for each of pixels; and a liquid ejecting controller for controlling said scanning device to move said liquid ejecting portion for scanning and for controlling said liquid ejecting portion to eject the liquid to a pixel according to the liquid ejecting data generated by said data generator in n−1 or less scanning cycles; and (b) a print data sending and receiving unit capable of sending print data to and receiving print data from an external apparatus;

wherein said ink-jet printing apparatus performs printing on a basis of print data received by said print data sending and receiving unit.

20. An information processing apparatus comprising:

(a) an ink-jet printing apparatus for performing printing by ejecting an ink from an ink ejecting portion and a liquid at least containing a material which insolubilizes or coagulates a coloring material in the ink from a liquid ejecting portion, to a printing medium, said ink-jet apparatus comprising:

a scanning device for moving the ink ejecting portion and the liquid ejecting portion for scanning;

an ink ejecting controller for controlling said scanning device to move said ink ejecting portion n (n is an integer not less than two) scanning cycles for one pixel and for controlling the ink ejecting portion to eject the ink to the pixel according to print data in said n scanning cycles;

a data generator for generating liquid ejecting data according to which said liquid ejecting portion ejects the liquid for pixels to be printed, on a basis of the print data for each of pixels; and a liquid ejecting controller for controlling said scanning means to move said liquid ejecting portion for scanning and for controlling said liquid ejecting portion to eject the liquid to a pixel according to the liquid ejecting data generated by said data generator in n−1 or less scanning cycles; and (b) a computer;

wherein said ink-jet printing apparatus further comprises a print data receiving unit for receiving print data provided by said computer and performs printing on a basis of the print data provided by said computer.

21. An ink-jet printing apparatus for performing printing by ejecting an ink from an ink ejecting portion and a liquid at least containing a material which insolubilizes or coagulates a coloring material in the ink from a liquid ejecting portion, to a printing medium, said apparatus comprising:

a scanning device for moving the ink ejecting portion and the liquid ejecting portion for scanning;

an ink ejecting controller for controlling said scanning device to move said ink ejecting portion n (n is an integer not less than two) scanning cycles for one pixel and for controlling the ink ejecting portion to eject the ink to the pixel according to print data in said n scanning cycles; and a liquid ejecting controller for controlling said scanning device to move said liquid ejecting portion for scanning an for controlling the liquid ejecting portion to eject the liquid to a pixel according to liquid ejecting data in n−1 or less scanning cycles, wherein the liquid ejecting data, according to which said liquid ejecting portion ejects the liquid for pixels to be printed, is generated on a basis of the print data for each of the pixels.

* * * * *

UNITED STATES PATENT AND TRADEMARK OFFICE

CERTIFICATE OF CORRECTION

PATENT NO. : 5,864,350

DATED : January 26, 1999

INVENTOR(S) : MAKOTO SHIOYA, ET AL.

It is certified that error appears in the above-identified patent and that said Letters Patent is hereby corrected as shown below:

COVER PAGE [56] REFERENCES CITED,
Foreign Patent Documents, "64-063185 3/1989 Japan." should be deleted;
"3207665" should read --3-207665--;
"4358847" should read --4-358847--; and
"5155036" should read --5-155036--.

COLUMN 1,
Line 29, "proposals," should read --proposals--.

COLUMN 3,
Line 11, "example," should read --example, a--.

COLUMN 8,
Line 49, "increased to" should read --increased--; and
Line 66, "also" should read --also be--.

COLUMN 9,
Line 29, "cycle," should read --cycle, so--.

UNITED STATES PATENT AND TRADEMARK OFFICE

CERTIFICATE OF CORRECTION

PATENT NO. : 5,864,350

DATED : January 26, 1999

INVENTOR(S) : MAKOTO SHIOYA, ET AL.

It is certified that error appears in the above-identified patent and that said Letters Patent is hereby corrected as shown below:

COLUMN 16,
Line 16, "floppy or hard" should read --floppy disk or hard disk--.

COLUMN 18,
Line 38, "generated" should read --generated in--; and
Line 49, "for the" should read --for--.

COLUMN 20,
Line 46, "an" should read --and--.

Signed and Sealed this

Twelfth Day of October, 1999

*Attest:*

Q. TODD DICKINSON

*Attesting Officer*

*Acting Commissioner of Patents and Trademarks*